US006857377B2

(12) United States Patent
Herring et al.

(10) Patent No.: US 6,857,377 B2
(45) Date of Patent: Feb. 22, 2005

(54) LOAD BEARING STRUCTURE FOR A SHIPPING PALLET

(75) Inventors: Conrad C. Herring, 157 Ocean View Ave., Del Mar, CA (US) 92014; Richard A. Halavais, Santee, CA (US)

(73) Assignee: Conrad C. Herring, Del Mar, CA (US)

( * ) Notice: Subject to any disclaimer, the term of this patent is extended or adjusted under 35 U.S.C. 154(b) by 0 days.

(21) Appl. No.: 10/364,867

(22) Filed: Feb. 10, 2003

(65) Prior Publication Data

US 2004/0007164 A1 Jan. 15, 2004

Related U.S. Application Data

(63) Continuation-in-part of application No. 09/978,861, filed on Oct. 16, 2001, now Pat. No. 6,708,628.

(51) Int. Cl.[7] ..... B65D 19/00
(52) U.S. Cl. ..... 108/51.11; 108/57.12
(58) Field of Search ..... 108/51.11, 57.12, 108/53.1, 55.3, 57.25, 57.29

(56) References Cited

U.S. PATENT DOCUMENTS

| | | | | |
|---|---|---|---|---|
| 893,703 A | | 7/1908 | Butler | 108/51.11 |
| 1,612,382 A | * | 12/1926 | Lehman | |
| 1,812,218 A | * | 6/1931 | Powell | |

(List continued on next page.)

FOREIGN PATENT DOCUMENTS

| | | |
|---|---|---|
| FR | 2362053 | 3/1978 |
| JP | 3-116844 | 5/1991 |

OTHER PUBLICATIONS

Webster's Encyclopedic Unabridged Dictionary of the English Language, Portland House, 1989, p. 77.

Hiel, Clem, "Questions Pave Way to Innovation", Composites Technology Jul./Aug. 2001, p. 17.

PCT Search Report and Written Opinion, dated Jul. 29, 2004, Int. Appn. No. PCT/US04/03815, (8 pages).

*Primary Examiner*—Jose V. Chen
(74) *Attorney, Agent, or Firm*—Law Offices of James D. McFarland

(57) ABSTRACT

A shipping pallet that has a load bearing deck with a plurality of domes that provide high strength, stiffness, and rigidity to the deck, and an undercarriage for supporting the deck and for receiving a forklift, palletjack, hand truck, or other automated machinery. Each dome is defined by an apex located proximate to the upper surface of the deck and a plurality of legs extending from the apex and ending at the lower surface of the deck. The domes are arranged adjacent to each other and define an array such that a load applied to the upper surface of the deck, substantially on the apex of the domes, will cause the applied forces from the load to be transmitted substantially laterally along the legs of the arches thereby producing intersecting compressive forces between adjacent domes that enable the load bearing deck to have high strength, stiffness, and rigidity.

57 Claims, 10 Drawing Sheets

U.S. PATENT DOCUMENTS 2,123,714 A * 7/1938 Clark
2,455,197 A * 11/1948 Sullivan
2,481,233 A * 9/1949 Morset
2,570,326 A 10/1951 De Angelis ..... 52/521
3,267,882 A * 8/1966 Rapson
3,750,598 A * 8/1973 Campbell et al.
3,861,326 A * 1/1975 Brown
4,051,787 A 10/1977 Nishitani et al. ..... 108/55.3
4,159,681 A * 7/1979 Vandament
4,397,246 A 8/1983 Ishida et al. ..... 108/55.3
4,415,619 A 11/1983 Fuglein ..... 428/131
4,784,194 A 11/1988 Danner ..... 144/286.1
4,977,711 A 12/1990 Prignitz ..... 52/309.8
5,052,307 A * 10/1991 Morrison
5,105,948 A 4/1992 Morris et al. ..... 206/519
5,170,722 A * 12/1992 Friesner et al.
5,226,372 A 7/1993 Frenkel et al. ..... 108/57.12
5,365,859 A * 11/1994 Schrage
5,402,735 A * 4/1995 DeJean
5,417,167 A * 5/1995 Sadr
5,456,189 A * 10/1995 Belle Isle
5,497,709 A * 3/1996 Gonzalez et al.
5,570,643 A 11/1996 Werner ..... 108/51.11
5,601,035 A * 2/1997 Herring et al.
5,643,656 A 7/1997 Lin ..... 428/174
5,816,172 A 10/1998 Carter ..... 108/51.3
5,941,179 A 8/1999 Herring
6,041,719 A 3/2000 Vidal et al.
6,142,440 A 11/2000 Gratz et al.
6,234,088 B1 5/2001 Bredal et al.
6,361,013 B1 3/2002 Smith
6,386,118 B1 5/2002 Bendit et al.
6,389,989 B1 5/2002 Hagerty
6,708,628 B2 3/2004 Halavais ..... 108/51.11

* cited by examiner

LOAD BEARING STRUCTURE FOR A SHIPPING PALLET

CROSS-REFERENCE TO RELATED APPLICATION

This is a continuation-in-part of application Ser. No. 09/978,861, filed Oct. 16, 2001 now U.S. Pat. No. 6,708,628 entitled LOAD BEARING STRUCTURE FOR SHIPPING PALLET, which is incorporated by reference herein in its entirety.

BACKGROUND OF THE INVENTION

1. Field of the Invention

The present invention generally relates to shipping pallets. More specifically, the invention is directed toward a pallet comprising a load bearing deck and an undercarriage for receiving a forklift, palletjack, hand truck or other automated machinery.

2. Description of Related Art

Shipping pallets are used as portable platforms to handle, store and transport loads such as food, beverage, and most every product or product component produced. A pallet is typically made of wood and has slats and posts arranged to provide a top surface and open access underneath for a forklift-type device. Bottom slats may also be added to provide for transport on conveyer belts, for use in automated machinery, and to add strength, stiffness, and rigidity to the pallet. Currently, the world market exceeds 1.5 billion pallets sold annually with the United States alone accounting for half a billion sales, and predictions are that sales will increase.

Conventional shipping pallets are usually constructed of wood or wood products with numerous associated problems. Wood pallets are heavy, expensive (especially those designed for four-way entry for a forklift) and subject to insect infestation. Some shipping pallets are constructed from alternative materials, but no matter what construction material is used, conventional shipping pallets suffer from one or more significant problems: limited strength, especially over extended periods of time, cumbersome weight, flexibility and bendability, high expense, limited usability, complex production requirements, ecological unacceptability, and inability to reuse or recycle.

U.S. Pat. No. 5,816,172 to Carter discloses a pallet constructed from paperboard. The pallet includes a plurality of elongated runners constructed from cylindrical cores and a deck formed from a number of elongated arcuate segments of the cylindrical cores.

U.S. Pat. No. 6,041,719 to Vidal et al. discloses a pallet with an upper tray for receiving a load and a lower face that has reinforcing and supporting elements attached thereto. The reinforcing and supporting elements are V- or U-shaped elements and extend longitudinally and transversely along the lower face.

U.S. Pat. No. 6,386,118 to Bendit et al discloses a one-piece hollow, continuous pallet that has a deck and underside. The underside includes structural features that function in conjunction with the deck for support and reinforcement when a load is placed on the pallet. The structural features include an arched bottom recess, side impact depressions, and "kiss-off" structures. The pallet may be made using rotational molding processes.

SUMMARY OF THE INVENTION

A shipping pallet is disclosed that has a load bearing deck for receiving a load and an undercarriage for supporting the deck. The deck comprises an array of domes that provides high strength, stiffness, and rigidity, which makes the pallet suitable for long-term and heavyweight use. In some embodiments the domes have an open structure that reduces material requirements, thereby allowing the pallet to be manufactured at lower weight and lower cost. The pallet may be manufactured from a plastics material; thus the pallet may be recyclable, ecologically acceptable, and resistant to insect infestation. Additionally, the undercarriage of the pallet may be designed in any appropriate manner for four-way entry of a forklift, palletjack, or other automated machinery, making the pallet more versatile than many conventional pallets.

The shipping pallet comprises a load bearing deck that defines an upper surface for receiving the load and a lower surface opposite the upper surface. The load bearing deck comprises a plurality of domes, wherein each dome is defined by an apex located proximate to the upper surface and a plurality of legs extending from the apex and ending at the lower surface. The domes are arranged in an array including a plurality of adjacent domes.

The array of domes may be defined by a plurality of dome rows that extend in at least two directions and intersect each other at a non-zero angle to form a pattern. In one embodiment, the array pattern may comprise a honeycomb such that any three adjacent dome apexes approximately define an equilateral triangle. In an alternative embodiment, the array pattern may comprise a grid such that four adjacent dome apexes approximately define a square.

In some embodiments, the domes may comprise an open dome structure; that is, the domes may be defined by a plurality of arches having apexes that define the dome apex, and two legs extending from each of the arch apexes that define the dome legs. Openings are defined between the dome legs thereby forming the open dome structure. In alternative embodiments, the plurality of domes may comprise a closed dome structure; that is, the domes may be defined by a surface, which may be thought of as an infinite number of arches angularly rotated through 360° with no openings therebetween.

The array of open domes may be defined by a plurality of intersecting arch rows with each arch row comprising a plurality of adjacent arches in some embodiments. In these embodiments, each of the plurality of arches within the arch rows comprise an apex and two legs that extend from the apex to the lower surface of the deck, and the arch rows are arranged such that the arches intersect approximately at their apexes thereby defining the array of domes.

In some embodiments, the domes may define a substantially circular curvature, and the distance between two adjacent dome apexes may be approximately equal to two times the radius of curvature. In other embodiments, the radius of curvature may be different and/or the domes may comprise a non-circular shape.

The domes may comprise a partial arch configuration in some embodiments; that is, the arches that form the dome may comprise a partial arch configuration defined by the legs ending in a substantially non-vertical orientation.

The deck may comprise structural fill that extends from and between the legs of at least some adjacent domes and provides continuity and additional structure to the load bearing deck. Circular hoops may be provided where the domes end at the lower surface of the load bearing deck. Webbing may be provided between the circular hoops on the lower surface of the deck to provide continuity and structure to the lower surface of the deck.

The deck may include a lower framework that extends from the lower surface of the deck, including a plurality of ribs and/or a plurality of beams that extend downwardly from the webbing. The ribs may extend along the lower surface of the deck and are situated between the domes. The beams may extend through the middle of one or more rows of domes and may also extend from the upper surface of the deck to a point below the webbing.

The undercarriage of the shipping pallet may include a plurality of posts connected to the deck, extending from the lower surface of the deck, wherein the posts may comprise stability ribs located therein. The plurality of posts may also include a center post that comprises arched stability ribs. The plurality of posts are situated in any suitable configuration; for example the posts may define spacing between the posts dimensioned to receive at least one of a forklift, palletjack, and hand truck.

In some embodiments, the upper surface of the load bearing deck defines an approximately flat plane, and the dome apexes may be configured to extend above the flat plane such that the upper surface of the deck is uneven.

Advantageously, the shipping pallet can be designed to have a low profile; for example, a height measured from the upper surface of the load bearing deck to the bottom surface of the posts may be less than about 5.0".

BRIEF DESCRIPTION OF THE DRAWINGS

For a more complete understanding of this invention, reference is now made to the following detailed description of the embodiments as illustrated in the accompanying drawings, wherein.

DETAILED DESCRIPTION

Figure 1:
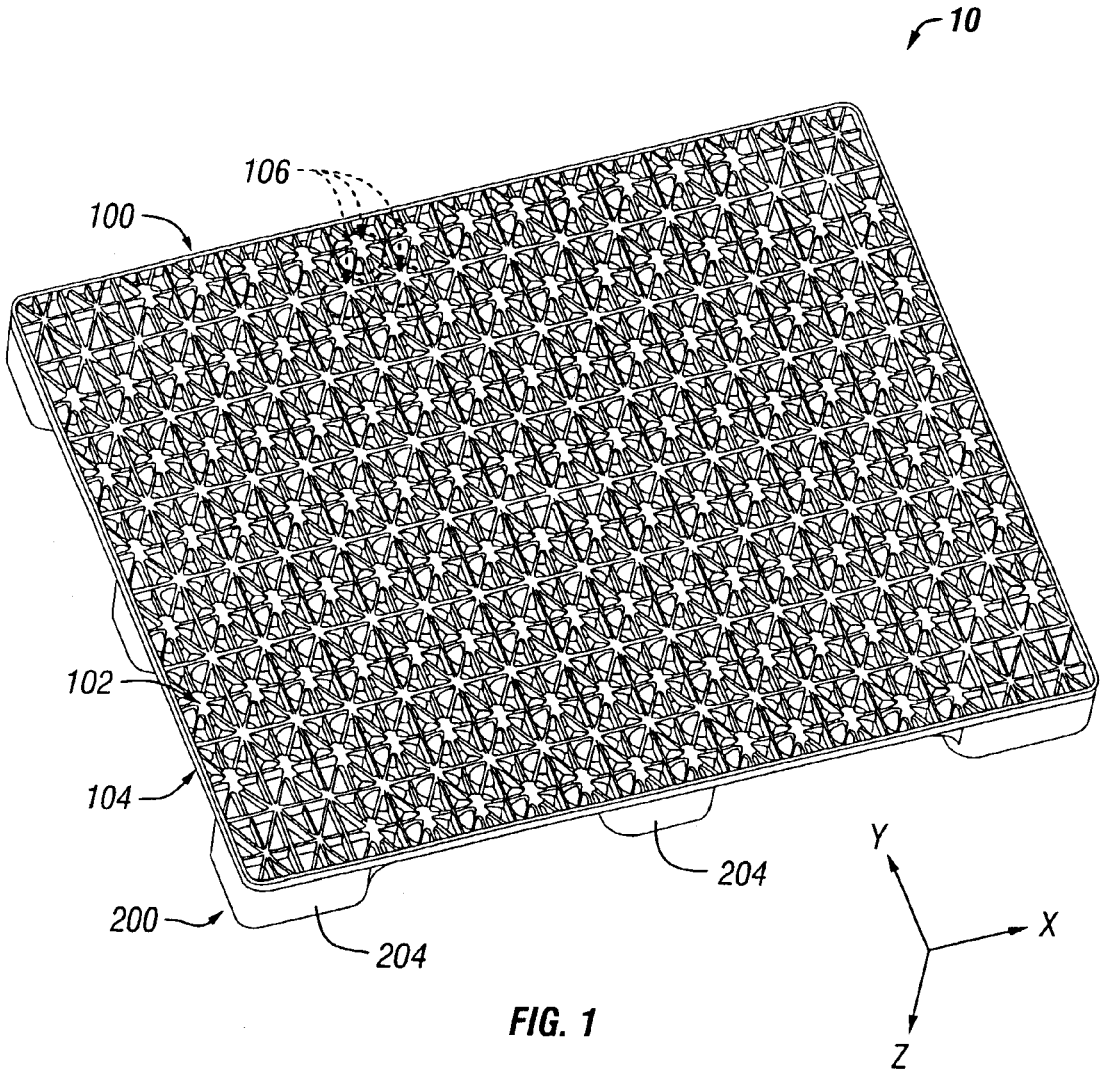
FIG. 1 is a perspective view of one embodiment of a shipping pallet.

This invention is described in the following description with reference to the figures, in which like numbers represent the same or similar elements.

Glossary of Terms and Acronyms

The following terms are used throughout the detailed description:

arch A structure that begins at an apex has two legs that extend downwardly from the apex toward their lower ends. An arch transmits an applied load in two directions substantially laterally through the legs of the arch. A "full" arch extends fully from the apex through to a point wherein both legs are substantially vertically oriented at their lower ends. A "partial" arch has legs that have been truncated short of a full arch, such that the legs are non-vertically oriented at their lower ends.

arch row A row comprising a plurality of arches.

dome A three-dimensional element defined by a plurality of arches angularly arranged at varying degrees about a vertical axis extending through the apex of the arches such that the apexes of the plurality of arches coincide with each other at their vertical axes. An "open" dome is defined by a finite number of arches angularly arranged at differing degrees less than 360°, which provide open areas between the legs of the arches such that an applied load is transmitted laterally in a finite number of directions defined by the legs of the finite number of arches. For example, three arches may be arranged at equal 60° intervals about the vertical axis; or four arch rows may be arranged at 30°–60°–60°–30° intervals. A "closed" dome is a surface rather than discrete arches, which may be thought of as an infinite number of partial arches rotated 360° about the vertical axis such that an applied load is transmitted in an infinite number of directions.

deck The upper load bearing structure of a pallet on which a load is placed.

undercarriage The supporting structure of a pallet below the deck for supporting the deck and load.

Overview

In the figures, like reference numbers indicate the same elements throughout. The figures generally show various views and elements of one embodiment of a shipping pallet comprising a deck that has a load-bearing structure for securely supporting heavy loads over extended time periods, and an undercarriage for supporting the deck and designed to allow four-way entry for a forklift, palletjack, hand truck or other automated machinery. The design of the load bearing deck includes a plurality of domes designed and situated adjacent to each other to create increased strength and durability to the pallet through the distribution of forces, as will be described herein.

In one embodiment, the pallet comprises a deck and an undercarriage injection-molded as one unitary piece from a polyethylene material, however a variety of materials and manufacturing processes can be used. For example, polyolefin, such as polyurethane, polypropylene, polyvinylchloride and polycarbonates, as well as composites thereof, are known in the art and can be used to provide a desired strength, stiffness, rigidity, weight, impact resistance, and durability.

In some embodiments, the pallet is specifically designed for manufacture by conventional molding processes, that is, the molding process fully forms and easily releases the end product pallet such that no post-molding steps or processes are necessary. For example, injection molding is a method of forming articles by heating the molding material until it can flow, and then injecting it into a mold at high pressure (e.g., 1500 PSI). The mold is typically two pieces that together form a cavity between which the molding material forms its shape. Thus, by designing a pallet that allows the two pieces of the mold to pull away from the top and bottom of the pallet, efficient and low cost manufacturing may be obtained.

The pallet can be manufactured from a variety of other known processes, such as Reactive Injection Molding (RIM). RIM is a process comprising injecting into a closed mold, under low pressure (e.g. 72 PSI), two or more reactive components mixed within a nozzle just prior to their introduction into the mold. For example, the reaction of a polyol and an isocyanate can be used to form polyurethane.

In some embodiments, the pallet is manufactured as one unitary piece; that is, the deck and the undercarriage are molded together. However, in alternative embodiments, the pallet may be manufactured as two separate pieces; that is, the deck and undercarriage may be molded as separate pieces and then secured together.

The pallet can be manufactured at a relatively low weight: less than 30 pounds, sometimes less that 25 pounds, and even less than 15 pounds in some embodiments. The low weight pallet design is made possible in part by the design of the load bearing deck including an array of open domes, such as will be described in detail with reference to the figures. That is, the strength provided by the array of open domes enables the use of minimal material with maximum structural integrity. The weight of the pallet may also be determined in part by the material selected for manufacture.

In one example embodiment, the deck of the pallet is a standard size, about 48.0" by about 40.0" by about 1.0", however it should be understood that the deck could be manufactured for a pallet of any size.

In alternative embodiments, the structure of the load bearing deck may be designed for other uses. For example, the load bearing structure could have upwardly extending surfaces that form some or all sides of a container box used for holding and ripening of fruit. In an alternative use, the load bearing structure could be useful for construction purposes such as flooring on the deck of a boat.

In one alternative embodiment, the thickness of the deck may be increased from about 1.0" to about 1.5" by increasing the dimensions of the domes, for example. By increasing the thickness of the deck, the rigidity of the pallet will increase, thereby enabling support for heavier loads over longer periods of time.

Detailed Description

FIG. 1 is a top perspective view of one embodiment of a shipping pallet 10. The pallet comprises a deck 100 that has an upper surface 102, a lower surface 104, and an undercarriage 200 that comprises a plurality of posts 204 extending from the lower surface of the deck. The deck 100 comprises a plurality of adjacent domes 106 that define an array of domes. The array of domes provides strength for the load bearing deck as will be described elsewhere in detail with reference to FIGS. 6 to 8C. In some embodiments as will be described, the domes are created by intersecting rows of arches.

For reference purposes herein, the x-, y- and z-axes of the pallet are defined and shown such that the x- and y-axes extend respectively longitudinally and transversely along the plane of the pallet 10, and the z-axis extends vertically through the pallet.

Arch Design

Reference is now made to FIGS. 2 through 5 to show the progressive design of arches to theoretically illustrate a partial arch design applied to the domes of the load-bearing deck in one embodiment, and also to show the force transfer that occurs between arches under an applied load.

Figure 2:
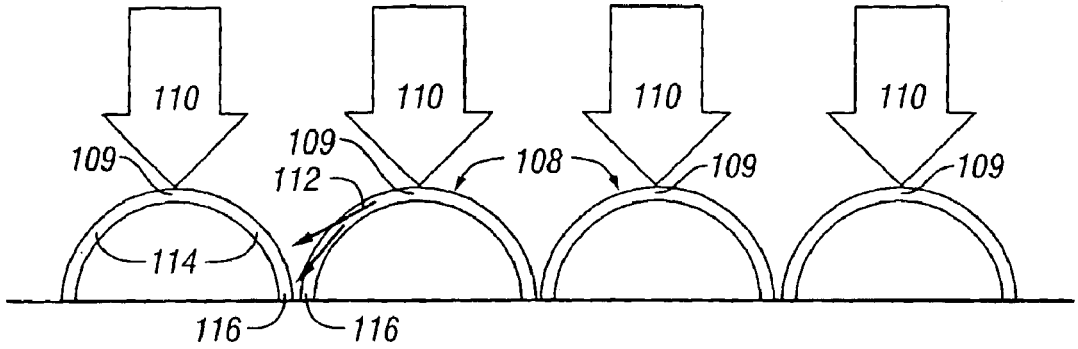
FIG. 2 is a side view of a plurality of full arches showing how the forces of an applied load are pushed outward along the legs of the arch.

FIG. 2 is a side view of a plurality of full arches 108 that form an arch row. Each arch has an apex 109 and two legs 114 that extend downwardly from the apex 109 in opposite directions to ends 116. It should be noted that full arches 108, such as shown in FIG. 2, have legs 114 that are substantially vertically oriented at their ends 116.

It should be noted that although the theoretical example of FIG. 2 shows an arch with a semi-circular shape for purposes of illustration, a variety of different arch shapes could be applied to the dome design, for example: segmental, stilted, blunt, equilateral, lancet, 3-centered (basket handle), 4-centered (Tutor), ogee, and Florentine arches such as shown in Webster's Encyclopedic Unabridged Dictionary of the English Language, 1983, p. 77.

The equilateral arch, for example, begins at an apex and has two legs of constant curvature extending therefrom, wherein the center of radius of the curvature of each of the two legs is located at the end of the other of the legs. Another example of an alternative arch shape is one type of primitive arch that begins at an apex and has two legs that extend in a straight line diagonally downward in opposite directions for a distance and then extend vertically downward. It should be understood that alternative embodiments of the domes of the load bearing deck could be designed using arch shapes other than semi-circular, such as described above.

FIG. 2 shows how a load 110 applied substantially to the apex 109 of the arches 108 pushes forces 112 substantially laterally outward along the legs 114 of the arch 108. It should be noted that a load 110 may be anything that can rest on the upper surface of the shipping pallet. For example, the load might be large bags of cement, crates of fruits, or any imaginable product that is shipped or stored.

Under an applied load 110, an arch 108 is always in compression because the structure of the arch reduces the effects of tension on the underside of the arch; that is, the force 112 is transmitted substantially laterally along the legs 114 of the arches 108 toward their lower ends 116, thereby transmitting a significant portion of the load substantially laterally outwardly from the arch.

Figure 3:
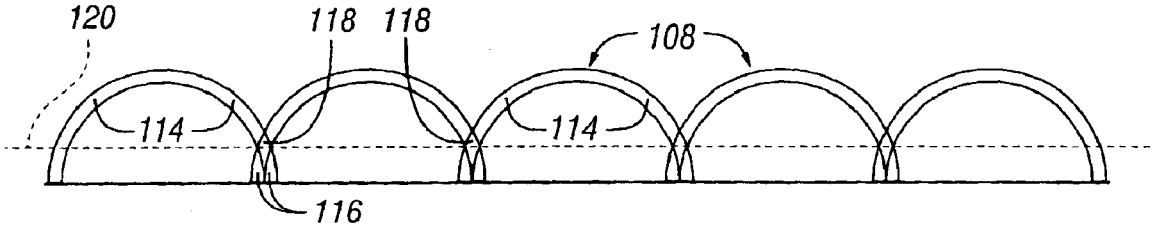
FIG. 3 is a side view of a plurality of theoretical full arches that overlap each other at a plurality of intersection points.

FIG. 3 is a side view of a plurality of theoretical full arches 108 that overlap each other. Particularly, FIG. 3 shows the plurality of full arches 108 overlapping at theoretical intersection points 118 within their legs 114 at a point above their ends 116. A theoretical horizontal line 120 is shown as a dotted line that extends through the arches 108 at their theoretical intersection points 118 and represents the place at which the full arches 108 may be truncated to form partial arches 122, such as will be described with reference to FIG. 4.

Figure 4:
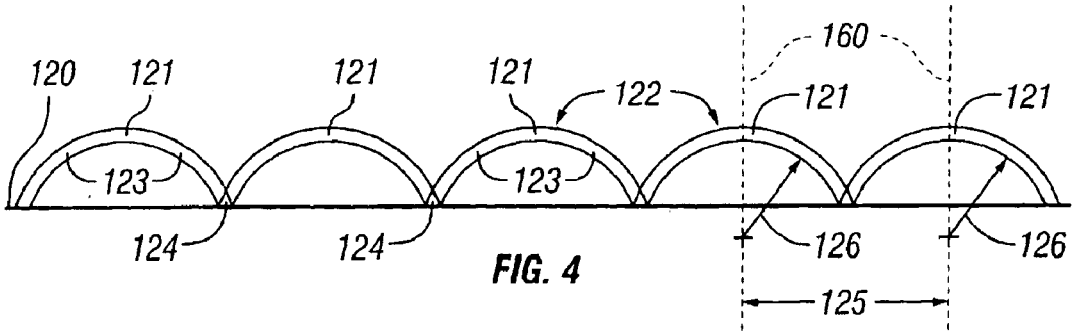
FIG. 4 is a side view of an arch row resulting from truncating the full arches of FIG. 3 at the intersection points shown in FIG. 3, thereby providing adjacent partial arches.

FIG. 4 is a side view of a plurality of partial arches 122 that form an arch row. FIG. 4 shows partial arches 122 each having an apex 121 and two legs 123 that extend downwardly from the apex 121 in opposite directions to ends 124. The ends 124 have been truncated along line 120 (shown in FIG. 3) to form partial arches 122 in accordance with the principles described above; that is, the partial arches in this embodiment are designed such that they would intersect each other if extended to their full arch length.

The partial arches 122 shown in FIG. 4 each define a centerline 160 that extends through the apex 121, a center-to-center distance 125 between two adjacent arch apexes, and a radius of curvature 126 of the partial arches 122. In one embodiment, it has been found that good results are provided when the center-to-center distance 125 is equal to approximately twice the radius of curvature 126.

The partial arches in one embodiment are designed by overlapping full arches (shown in FIG. 3) such that radius of curvature 126 is approximately 1.5" and the center-to-center distance 125 is approximately 3.0". In alternative embodiments, the dimensions of the partial arches may be increased or decreased, for example in one embodiment, a radius of curvature of approximately 2.0" and a center-to-center distance of approximately 4.0".

It should be noted that the center-to-center distance, the radius of curvature, the line at which the arches are truncated to form partial arches, and the theoretical or actual intersection point of the compressive forces of adjacent arches (such as described with reference to FIG. 5 below), may vary between embodiments dependent upon design factors. In other words, the arches may be brought closer together or spread farther apart, may have more or less truncation than shown in the figures, may have relatively greater or smaller radii of curvature, and may be circular or non-circular in shape, such as described in detail with reference to FIG. 2.

As will be described in detail with reference to FIGS. 6 to 8C, the arch rows including the design of partial arches discussed with reference to FIG. 4 are applied to create the domes 106 of the load bearing deck 100 in one embodiment. That is, a plurality of arch rows may be provided that intersect each other at their arch apexes to form an array of domes, so that each dome comprises a plurality of intersecting arches angularly arranged about a vertical axis that extends through their apexes. The advantages of the design of the partial arches 122 of FIG. 4 will now be discussed with reference to FIG. 5.

Figure 5:
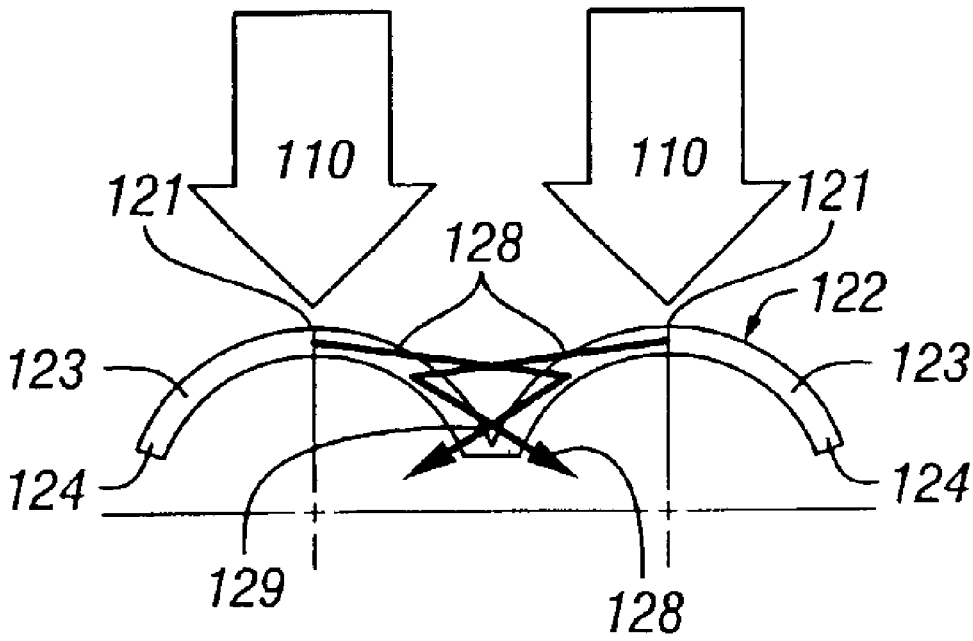
FIG. 5 is a side view of two adjacent partial arches, showing the intersecting compressive forces produced by an applied load.

FIG. 5 is a side view of two adjacent partial arches, illustrating the intersecting compressive forces produced by an applied load. FIG. 5 shows two adjacent partial arches 122 that each have an apex 121 and two legs 123 that extend downwardly from the apex 121 in opposite directions to ends 124. It may be noted that legs 123 have a substantially non-vertical orientation at their ends 124.

The arches 122 are situated such that the load 110 applied substantially to the arch apexes 121 transmits forces 128 laterally toward an intersection point 129 between adjacent partial arches 122, thereby producing compressive forces that counteract each other.

Thus, when a load bearing deck is designed with a plurality of domes 106 utilizing the design of intersecting partial arches such as described herein, the forces applied by a load to the load bearing deck are not only transmitted substantially laterally, but the tensile stresses, induced by a bending moment imposed upon on the structure from the applied load, are at least partially canceled by virtue of the forces between adjacent domes intersecting each other, which places the load bearing deck into compression and creates at least partially offsetting compressive forces within and between the domes.

Load Bearing Structure

Figure 6:
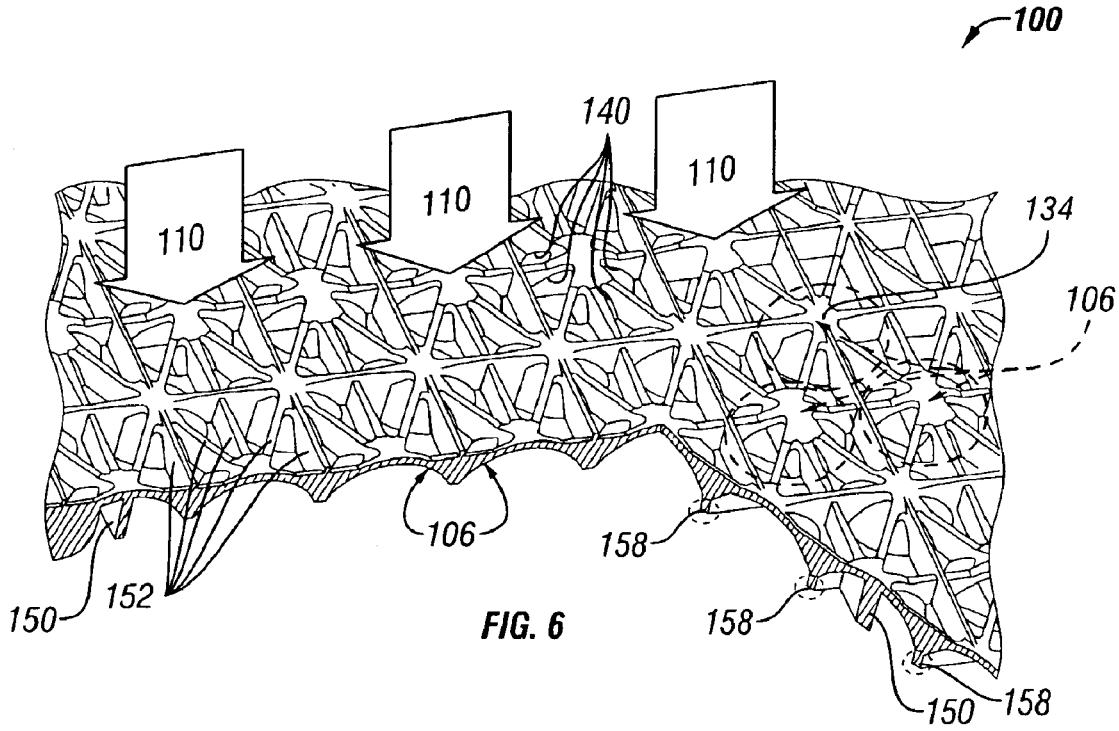
FIG. 6 is perspective view of a portion of the shipping pallet of FIG. 1 with a portion cut-away to show a cross-section of the inner load bearing structure.

FIG. 6 is perspective view of a portion of the shipping pallet 10 of FIG. 1 with a portion cut-away to show a cross-section of the inner load bearing structure. FIG. 6 shows the load bearing deck 100 that comprises an array of domes formed from a plurality of dome rows that each comprise a plurality of adjacent domes 106, a plurality of beams 150 that extend through the middles of at least some of the dome rows, structural fill 152 that extends at least partially between some of the adjacent domes 106, and ribs 158 that extend from the lower surface of the deck between the domes.

The array of dames comprises a plurality of dome rows such as will be described elsewhere in more detail with reference to FIG. 7. Each dome raw comprises a plurality of substantially adjacent domes 106 each having an apex 134 and a plurality of legs 140 that extend therefrom, such as will be described in more detail with reference to FIGS. 8A to 8C. The cross-section shown in FIG. 6 reveals the design of the domes including the partial arch shape such as described with reference to FIGS. 4 and 5; that is, adjacent domes 106 comprise adjacent partial dome structures that create a force transfer matrix such that the downward forces on the domes created by the load 110 are translated substantially laterally to produce intersecting compressive forces between adjacent dames, thereby at least partially counteracting the tensile forces normally encountered in a loaded deck, In some embodiments, beams 150 extend through the middles of at least some of the dome rows. The beams may have a vertical height substantially equal to the height of the deck, a horizontal length that extends part or all of the length of a dome row (such as will be described with reference to FIGS. 7 and 9A), and a thickness approximately equal to that of the legs 140 of the domes 106. Beams 150 provide added structural strength to the load bearing deck and may aid in the injection-molding process by providing a path for material flow. In one example embodiment, the beams have a thickness of about 0.5 inches and extend below the lower surface of the deck by about 0.5 inches. In other embodiments, those dimensions may be varied according to desired material flow and structural properties.

In some embodiments, structural fill 152 extends at least partially between some of the adjacent domes and fills in space between adjacent legs of adjacent domes. The structural fill 152 provides strength to the load bearing deck and aids in the injection-molding process by providing a path for material flow. In alternative embodiments, structural fill may be added or omitted as desired to increase rigidity or decrease weight, for example.

Figure 9A:
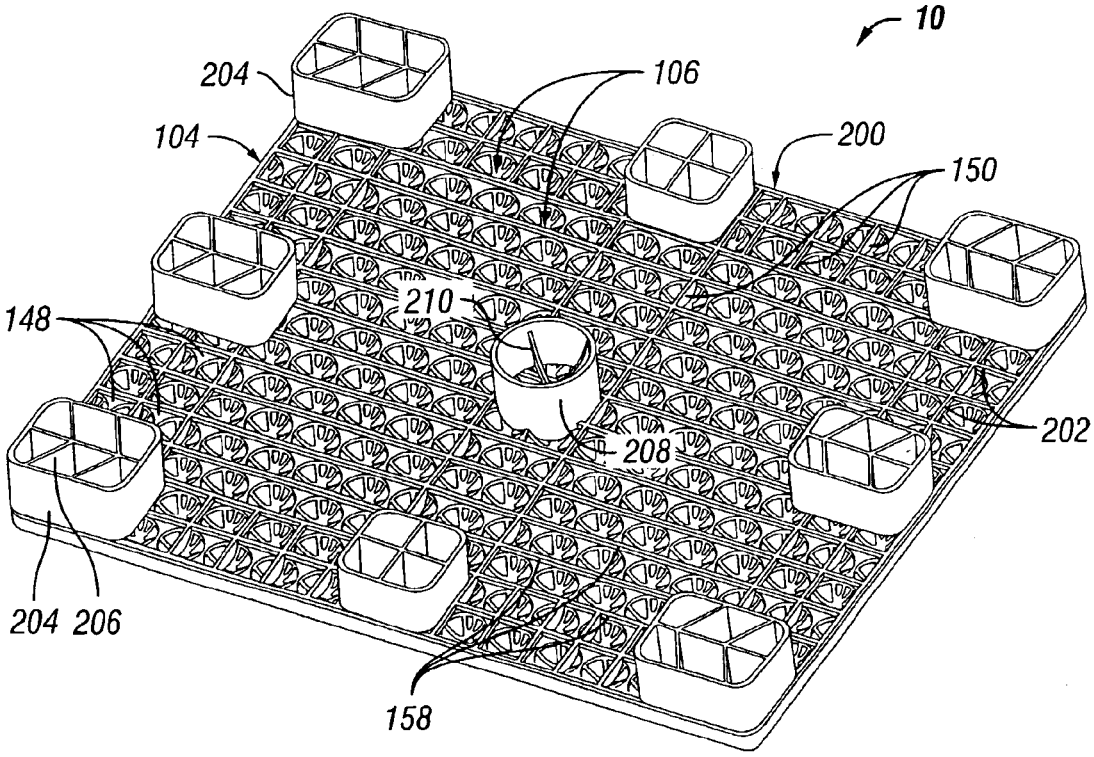
FIG. 9A is a bottom perspective view of the pallet showing one embodiment of the undercarriage and supporting framework.
Figure 9B:
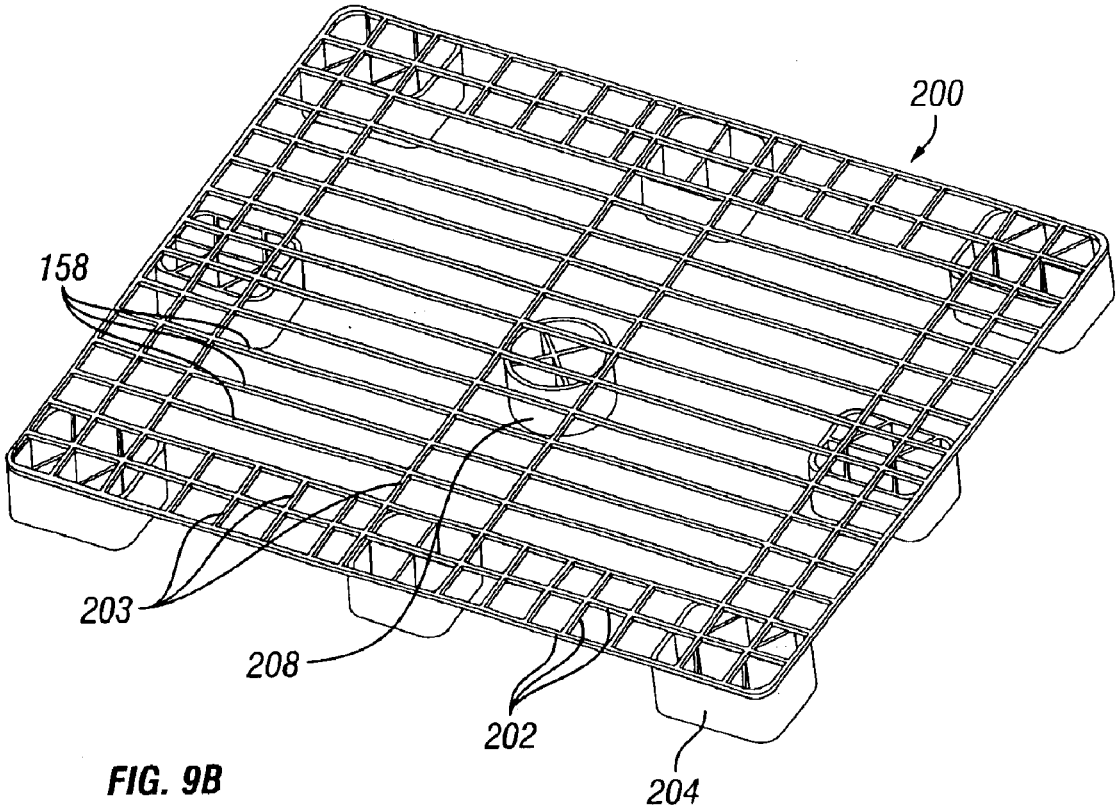
FIG. 9B is a top perspective view of the embodiment of FIG. 9A showing the undercarriage and supporting framework.

In some embodiments, ribs 158 may be provided on the lower surface of the deck, described elsewhere in detail such as with reference to FIGS. 9A and 9B. The ribs 158 provide strength to the load bearing deck and aid in the injection-molding process by providing a path for material flow

Deck

Figure 7:
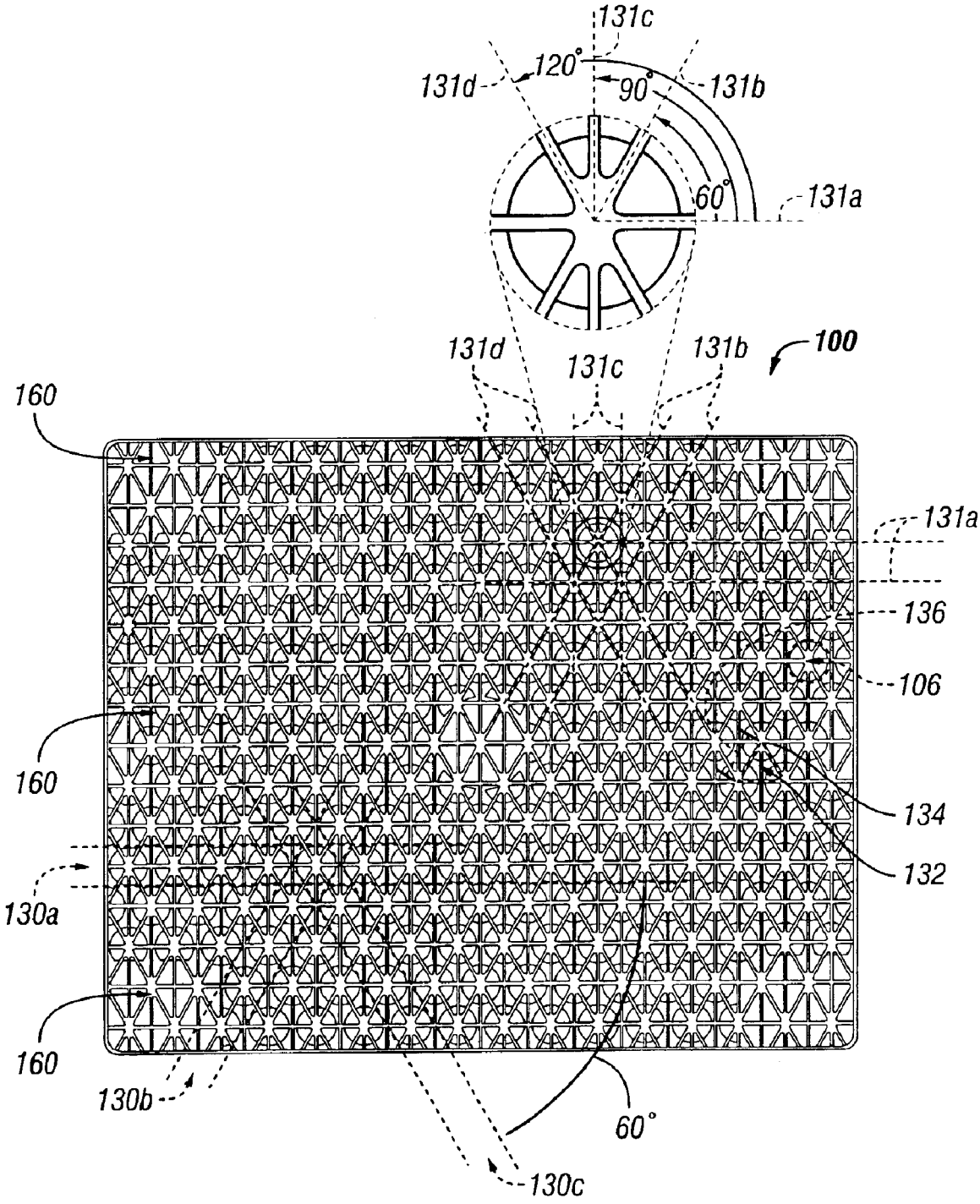
FIG. 7 is a top view of the deck of the shipping pallet of FIG. 1.

FIG. 7 is a top view of one embodiment of deck 100. FIG. 7 shows the load bearing deck 100 that comprises an array of domes. In one aspect, the array of domes are formed from a plurality of dome rows 130 that intersect each other at a non-zero angle. In another aspect, the array of domes are formed from a plurality of arch rows 131 that intersect each other at a non-zero angle to form the domes 106. The array of domes, whether viewed from the perspective of dome rows or arch rows, comprises a plurality of adjacent domes, each dome having an apex 134 and a center-to-center distance 136 measured between adjacent dome apexes.

In one aspect of the embodiment of FIG. 7, the load bearing deck 100 comprises an array of domes formed from plurality of intersecting dome rows. Each dome row 130 comprises a plurality of adjacent domes 106, such as described in more detail with reference to FIGS. 8A to 8C. The plurality of dome rows extend in at least two different directions that cross each other at an angle in the range of 0° to 180°. For example, FIG. 7 shows: a first dome row 130*a* that extends in a first direction (horizontal in FIG. 7); a second dome row 130*b* that extends in a second direction (at a 60° diagonal to 130*a*); and a third dome row 130*c* that extends in a third direction (at a 60° diagonal to 130*b*). It should be noted that the array of domes is formed by a plurality of sets of parallel dome rows, however only one row in each direction is highlighted in FIG. 7 for clarity.

In the embodiment of FIG. 7, the dome rows 130 extend in first, second, and third directions that cross each other at about 60° intervals, thereby creating a honeycomb-like pattern. The honeycomb-like pattern may be defined by equilateral triangles 132 formed between the apexes 134 of three adjacent domes 106. In one embodiment, the distance 136 between adjacent apexes is about 3.0 inches, however the pattern could be alternately dimensioned as desired, for example 4.0 inches, or more, or less.

One advantage of the honeycomb-like pattern is that it is resistant to twisting because of interference caused by the off-setting structure of the domes 106. Another advantage of the honeycomb-like pattern is that it enables more efficient use of material, that is, a greater number of domes will fit into a specified area, compared to other patterns (e.g. rows at 90°), thereby increasing the strength of the load bearing deck and thus the ability to hold heavy loads over extended periods of time.

In alternative embodiments the rows of domes could cross each other at alternative angles such as 30°, 45° and 90°, thereby creating alternative patterns. For example, dome rows may be arranged such that they extend in only two directions that intersect each other at a 90° angle, thereby creating a grid pattern. The grid pattern may be defined by squares formed between the apexes of four adjacent domes.

In another aspect, FIG. 7 shows the load bearing deck 100 comprising an array of domes formed from plurality of intersecting arch rows 131*a*, 131*b*. 131*c*, and 131*d*. A first set of parallel arch rows 131*a* extend in a first direction, a second set of parallel arch rows 131*b* extend in a second direction, a third set of parallel arch rows 131*c* extend in a third direction, and a fourth set of a parallel arch rows 131*d* extend in a fourth direction, wherein the second direction intersects the first direction at an angle of about 60°, the third direction intersects the first direction at an angle of about 90°, and the fourth direction intersects the first direction at an angle of about 120°. It should be noted that in alternative embodiments, the plurality of arch rows may extend in a plurality of different directions that cross each other at angles other than described above, within the range of 0° to 180°.

Each arch row 131 comprises a plurality of adjacent arches 122, such as described in more detail with reference to FIGS. 4 and 5. It may be noted that the plurality of arches intersect each other at their apexes.

Thus, in the embodiment shown in FIG. 7, the array of domes are formed by intersecting arch rows 131*a*, 131*b*, 131*c*, and 131*d*. That is, a plurality of rows each comprising a plurality of adjacent arches intersect each other at their arch apexes at a non-zero angle thereby defining each dome within the array of domes.

In this aspect of the invention, the arch rows 131*a* to 131*d* may be designed as described with reference to FIGS. 4 and 5 and situated such that a load 110 applied to the intersecting arch rows transmits forces laterally, thereby producing compressive forces that counteract each other. For example: the plurality of adjacent arches that form the arch rows 131 may comprise a partial arch configuration; may have a curvature that is substantially circular; and may define a radius of curvature, wherein a distance between two adjacent arch apexes is approximately equal to two times said radius of curvature. In alternative embodiments, the arches that form the arch rows may comprise a non-circular shape.

In some alternative embodiments, the plurality of arch rows may intersect each other at alternative angles, and thus may comprise sets of parallel arch rows that extend in only two or three directions. For example: a first, second, and third set of parallel rows that extend in a first direction, second and third set of directions respectively, wherein the second direction intersects the first direction at an angle of about 60° and the third direction intersects the first direction at an angle of about 120° (not shown); and a first and second set of parallel rows that extend in first and second directions, wherein the second direction intersects the first direction at an angle of about 90° (not shown).

In some embodiments, at least some of the arch rows (e.g., 131*c*) are replaced by beams 150 that extend through the entire deck, as described in more detail with reference to FIG. 6. Additionally, at least some arch rows have structural fill 152 that fills space that would otherwise exist between the legs of adjacent arches such as described with in more detail with reference to FIGS. 8A to 8C. The structural fill 152 provides continuity, strength and aids in material flow, as described elsewhere in detail with reference to FIGS. 8A to 8C.

It should be noted that FIGS. 1 and 7 show an embodiment in which the domes extend over the entire deck except for the areas 160 from which the posts will extend (see FIGS. 9A and 9B for post locations), that is, the deck comprises fill material that covers the areas 160 from which the posts will extend; however this design is but one example embodiment. In alternative embodiments, it may be advantageous make alterations to the design for some reason such as to increase strength, decrease weight, or provide extra coverage for an area; for example, in some embodiments the domes extend across the entire deck of the pallet, and in other embodiments extra material may be cut away in various areas to decrease weight (not shown).

In yet another alternative embodiment, the areas 160 from which the posts extend are designed for nesting with another pallet; that is, the areas 160 may comprise apertures designed to receive the posts of another pallet such that a plurality of a pallets can nest within one another.

Figure 8A:
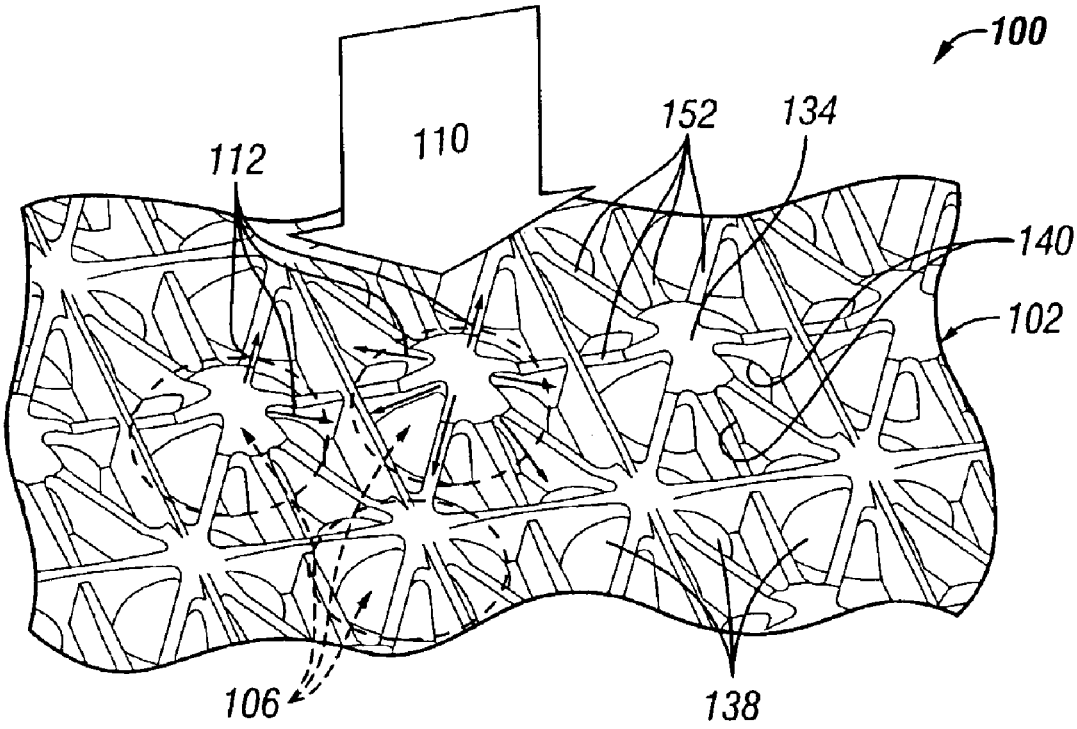
FIG. 8A is a top perspective view of several domes, showing the details of the upper portion of the domes and the transfer of forces from an applied load along the legs of the domes.
Figure 8B:
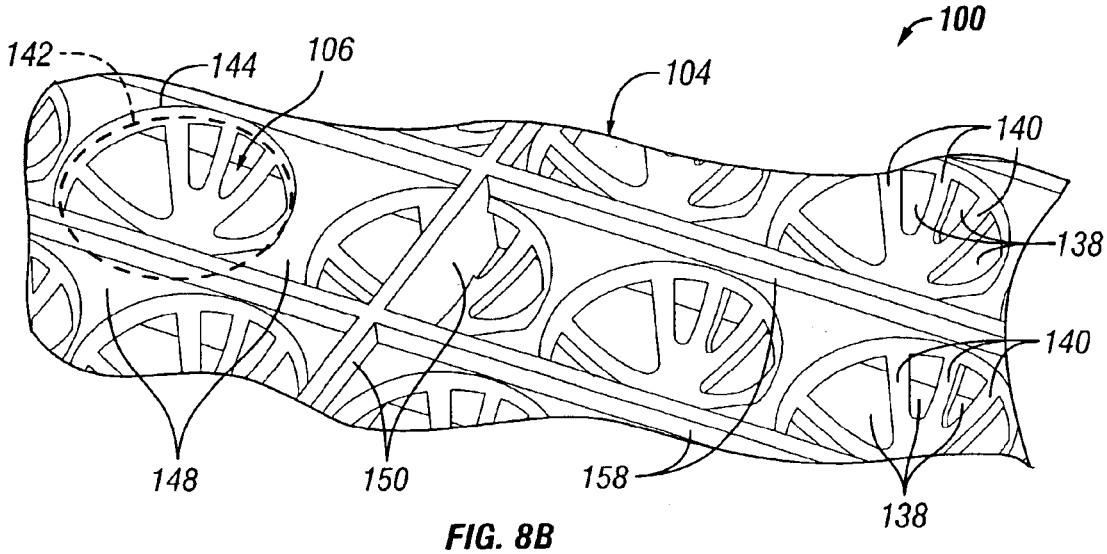
FIG. 8B is a bottom perspective view of several domes, showing the details of the bottom portion of the domes.
Figure 8C:
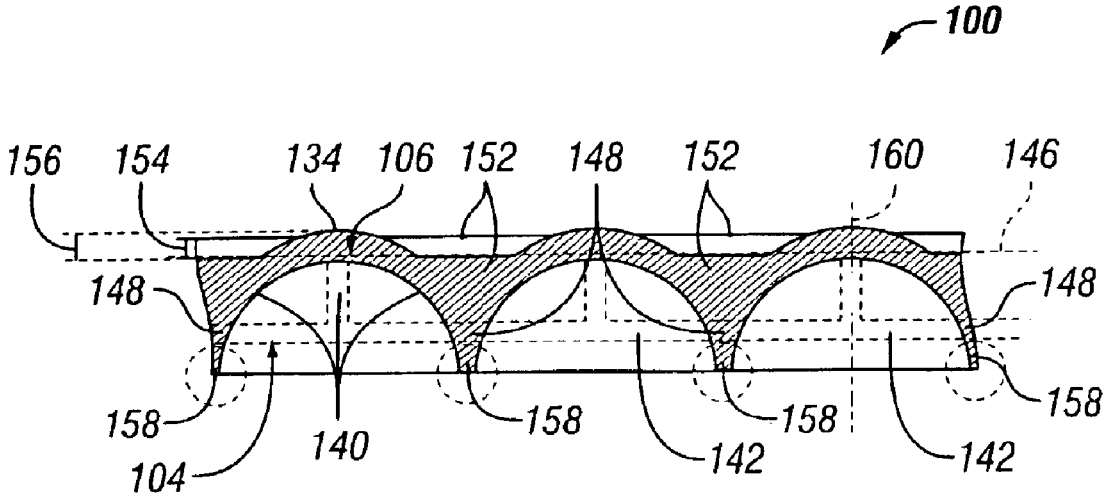
FIG. 8C is an elevational view of several domes.

FIGS. 8A, 8B and 8C are respectively top, bottom and side views of several domes in the deck. FIGS. 8A, 8B, and 8C are provided to reveal details of various aspects of the domes in one embodiment.

FIG. 8A is a top perspective view of several domes 106 in one embodiment of the pallet, showing the details of the upper surface 102 of the deck 100 and the configuration of the domes 106 such that the load 110 applied substantially to the dome apexes 134 will transmit forces 112 substantially laterally to produce intersecting compressive forces between adjacent domes 106.

FIG. 8A shows an embodiment of a pallet in which the domes 106 each have an an apex 134 and a plurality of legs 140 that extend downwardly from the apex 134 in a plurality of directions. Open areas 138 are formed between the legs 140 of the arches, and structural fill 152 is provided to fill in between legs of adjacent domes, such as will be described below.

An open dome structure is shown in one embodiment in FIGS. 8A to 8C. In an open dome structure, the domes are are defined at least in part by angularly arranging a plurality of arches about their vertical center axis 160 (FIG. 4) by varying degrees less than 360°. The domes 106 of FIG. 8A particularly illustrate at least three arches angularly arranged about their vertical center axis with openings 138 located where no legs exist, thereby creating the open dome structure.

It should be noted that in the illustrated embodiment, such as described elsewhere in more detail with reference to FIG. 7, some domes 106 are defined by four arches angularly arranged about their vertical center axis; other domes 106 comprise three arches angularly arranged about their vertical center axis, and a beam 150 (such as shown in FIGS. 8B and 9A) that extends through the middle of the dome. Beams 150 provide structural advantages, such as described elsewhere in more detail with reference to FIG. 6.

The open dome structure provides increased strength, as compared to an arch that transmits forces in only two directions (such as shown in FIGS. 2 to 5). In other words, in an open dome structure, the forces 112 are spread in many directions (e.g. at least six directions as shown in the embodiment of FIG. 8A) and thereby create offsetting compressive forces with more than two adjacent domes (e.g. six adjacent elements). Additionally, the open arch structure provides decreased overall weight to the pallet design, as compared with a closed structure (as described below), which may make the pallet more convenient to transport and store, less expensive to manufacture, and decrease the risk of work-related injuries that could otherwise be caused by a falling stack of pallets or overexertion of a laborer.

As shown in FIGS. 8A and 8C, the load bearing deck may include structural fill 152 that extends between legs 140 of adacent domes 106. The structural fill can provide strength to the load bearing deck and may aid in the injection-molding process by providing a path for material flow.

In an alternative embodiment, one or more of the domes 106 may comprise a fully closed dome structure; that is, the dome may be defined by a surface rather than discrete arches. The surface of the closed dome may be thought of as an infinite number of arches angularly rotated through 360°; i.e., closed domes do not have openings. In this alternative embodiment, some or all of the domes of the load bearing deck could be closed domes while others remain open.

FIG. 8B is a bottom perspective view of several domes, showing the details of the underside of the deck. FIG. 8B shows the underside of the domes 106 including legs 140 with openings 138 therebetween and ending in a circular hoop 142 at their lower end 144, which is located at the lower surface 104 of the deck. The bottom perspective view also reveals webbing 148 that extends between the domes' lower ends 144 to form at least a part of the lower surface 104 of the deck, beams 150 that extend through the middle of the domes, and ribs 152 that extend along the lower surface 104 of the deck between the domes.

The hoops 142 extend around the lower end 144 of each dome and may provide natural hoop strength to the load bearing deck 100 in one embodiment. The hoops 142 of adjacent domes are connected to each other by webbing 148 that provides continuity between the adjacent domes 106 and forms a part of the lower surface 104 of the load bearing deck 100.

Although the hoops 142 are shown as circular in shape, they may be shaped as diamonds, tringles, ovals or other shapes in alternative embodiments. It should be noted that the diameter of the hoop will vary as the dimensions and design of the domes are altered. For example, if the deck is made narrower and all else remains the same, then the hoop diameter will be smaller.

FIG. 8B includes a beam 150 such as described in more detail with reference to FIG. 6 that extends through the middle of at least some of the domes. FIG. 8B also illustrates how the ribs 158 described in more detail with reference to FIGS. 9A and 9B extend along the lower surface 104 of the deck between the domes 106.

FIG. 8C is an elevational view of several domes. FIG. 8C shows the domes 106 having an apex 134 and legs 140 that extend downwardly from the apex 134 in opposite directions ending at the lower surface 104. Structural fill is shown between adjacent arch legs 140, webbing 148 is shown between adjacent domes on the lower surface 104 of the deck, and ribbing 158 is shown extending below the webbing 148.

Dome apexes 134 extend above the flat plane of the deck 146 (defined by the outer edges of the upper surface of the deck as shown in FIG. 1) by an amount 156 (e.g. approximately 0.2" in one embodiment) to provide a slightly bumpy surface and thereby reduced slippage of a load placed on the deck upper surface.

The structural fill 152 extends between adjacent dome legs 140 and may extend above the flat plane of the deck 146 by a predetermined distance 154, which is typically less than the distance 156 that the apexes 134 extend above the plane of the deck (e.g. a difference of approximately 0.025" in one embodiment). As a result, the raised dome apexes 134 provide friction on the upper surface of the deck 102, which is useful to prevent the load from sliding off in transit.

In some embodiments, the structural fill 152 may comprise different thicknesses in different areas of the pallet; that is, the predetermined distance 154 may not be constant in all embodiments of the pallet such as shown in FIG. 8C. Additionally, it should be noted that the apex distance 156 and structural fill distance 154 may be approximately equal in some embodiments where a "bumpy" surface is not desired.

It should be noted that webbing 148 and ribs 158 are shown here, however they are described elsewhere in detail such as with reference to FIG. 9A.

Upper and Lower Camber

In one embodiment of the pallet, the deck 100 is formed to include an overall camber on its upper and lower surfaces (not shown). An upper camber is defined by a slightly upward curved overall arch toward the center of the deck.

In one embodiment, the curvature of the upper camber is provided by the positioning of the domes above the flat plane of the deck. In this embodiment, the domes that are located closest to the center of the deck extend above the flat plane of the deck by a distance greater than the domes located farther from the center of the deck, which extend above the flat plane at a progressively lesser distance than those at the center. The upper camber is typically very slight (e.g. in one embodiment, the difference between the distance of the center apex above the plane of the deck and the distance of the outer apexes above the plane of the deck is approximately 0.2"), however in alternative embodiments, the camber may be more or less pronounced.

One advantage of the upper camber as described herein includes decreased slippage of a load on the pallet. That is, when a product is loaded to the upper surface of the deck, the load itself will settle or slightly compress onto and around the individual domes and the camber, thereby increasing the friction and decreasing the possibilty of slippage between the load and the pallet deck.

The pallet may also include a lower camber in some embodiments (not shown). The lower camber in one embodiment may be incorporated into the design of the lower portion of the load bearing deck by decreasing the thickness of the webbing near the center of the pallet (or conversely increasing the thickness away from the center). The lower camber is at its highest point at the center of the deck and curves progressively downward as it extends farther away from the center of the deck, creating a slightly upward curved overall arch toward the center on the lower surface of the deck. The lower camber is typically very slight (e.g. the difference between the thicknesses of the webbing at the center and the thickness of the webbing farthest away from the center is approximately 0.2" in one embodiment), however in some embodiments, the camber may be more or less pronounced.

In other embodiments, the upper and lower cambers may be designed into the overall mold of the pallet, or may be provided by other processes such as shaping or natural warping incurred in the post-molding process, for example.

Undercarriage

FIG. 9A is a bottom perspective view of the pallet illustrating one embodiment of the undercarriage 200 and supporting framework 202 located below the lower surface 104 of the deck. The undercarriage 200 comprises a plurality of support posts 204, 208 that extend from the lower surface of the deck 104. The supporting deck framework 202 comprises beams 150 and ribs 158 that extend longitudinally and transversely along the lower surface 104 of the deck.

FIG. 9A illustrates how beams 150 extend through the middle of at least some of the domes rows, such as described in more detail with reference to FIG. 6. The beams 150 may have different lengths, such as shown in FIG. 9A, such that some extend across only part of the deck, while others extend entirely across the deck. The configuration of the beams may be altered in alternative embodiments as necessary to provide increased strength or decreased weight to the load bearing deck. It should be noted that beams 150 may extend below the webbing by approximately the same distance that the ribs 158 extend below the webbing.

FIG. 9A illustrates how ribs 158 extend along the lower surface 104 of the deck between the dome rows. The ribs extend from the webbing 148 of the lower surface of the deck and may provide additional structure for supporting the deck.

Although the beams 150 and ribs 158 extend across the lower surface 104 of the deck, including across and between the domes 106, they do not interfere with the structural function of the domes 106, and in fact provide additional strength, stiffness and stability to the pallet as a whole. Additionally, the beams 150 and ribs 158 may aid in the injection-molding process by providing a path for material flow.

The framework 202 of ribs 158 and beams 150 adds minimal size and weight to the pallet (e.g. extending below the lower surface of the deck with a 0.375" thickness and 0.2" width in one embodiment), however the framework may be dimensioned up or down according to desired strength, weight, size, manufacturing, and other requirements.

In some embodiments, the ribs 158 and beams 150 that create the framework 202 have different thicknesses in different locations. The locations, thicknesses, and other parameters may be dimensioned and arranged to meet a variety of structural parameters. In other embodiments, the ribs and/or beams may not be necessary.

In this embodiment of the undercarriage, the plurality of posts 204, 208 extend from the lower surface 104 of the deck to provide support for the deck of the pallet and are situated to define spacing between the posts dimensioned to receive at least one of a forklift, palletjack and hand truck.

In one embodiment, the posts 204, 208 are substantially hollow to minimize the overall pallet weight; stability ribs 206, 210 are formed within the posts to provide stability without significantly increasing the weight. The stability ribs 210 within the central post 208 comprise an arched configuration providing excellent strength and stability. The design of the arched stability ribs 210 could be applied to some or all of the posts 204 in some embodiments.

FIG. 9B is a top perspective view of the undercarriage 200 and supporting framework 202 of the embodiment of FIG. 9A. It should be noted that the framework 202 shown in FIG. 9B illustrates the ribs 158 and the lower portions 203 of the beams, both of which extend below the webbing on the lower surface of the deck. Particularly, FIG. 9B shows the configuration of the support posts 204, 208.

The configuration of the undercarriage is designed to receive a forklift, palletjack, hand truck or other automated machinery. Because of the arrangement and dimensions of the posts, the undercarriage of the pallet is designed to allow four-way entry for a forklift, palletjack, hand truck or other automated machinery, thus increasing the versatility, usability and flexibility of the pallet. That is, a forklift, palletjack or other automated machinery may enter through any of the four sides.

In an alternative embodiment, the pallet is designed to enable nesting of a plurality of shipping pallets (not shown). In this embodiment, the posts of the pallet are dimensioned to fit within apertures located on the upper surface of the deck and extend through the deck, such as described with reference to FIG. 7.

Low Profile

Because of the strength and stability of the deck, the pallet 10 may be designed and manufactured with a low profile, that is, a low overall thickness as compared with conventional pallets. Conventional pallets typically have a thickness between 5.5" and 6.5", which is approximately 1.0" to 2.0" more than a pallet designed as described herein.

In one embodiment of the deck, the dimensions of the domes 106 include radius of about 1.55", a wall thickness of about 0.2", and a center-to-center distance between adjacent apexes of about 3.0". The webbing 148 is dimensioned considering necessary strength and weight, for example a thickness of about 0.2". The total thickness of the deck therefore, taking into consideration the partial arch design of the domes, is approximately 1.065" in one embodiment, however the dimensions may be increased or decreased as desired.

In one embodiment, the dimensions of the undercarriage and lower framework include framework 202 extending about 0.2" below the deck and posts 204, 208 extending about 3.2" therebelow. The total thickness of the undercarriage and lower framework therefore, is approximately 3.4" in one embodiment, however it may be increased or decreased as desired.

Combining the dimensions described above (the thickness of the deck of 1.065" plus the thickness of the undercarriage of 3.4" equals an overall pallet thickness of approximately 4.6") illustrates a low profile shipping pallet design as compared with conventional pallets that typically measure 5.5" to 6.5" from top to bottom. The low profile design allows for storage of additional pallets in a specified area, as well as contributing to the overall lightweight design.

In an alternative embodiment, the thickness of the deck may be increased from the example embodiment above, such as by about 25% for example by increasing the inner radius, outer radius and center-to-center distance between the dome apexes. By increasing the thickness of the deck, the rigidity and load bearing strength of the deck will increase. Other alternative dimensions may be applied to the pallet in order to increase strength, decrease weight, or otherwise alter desired properties of the shipping pallet.

In an alternative embodiment, the deck can be designed using beams and trusses, similar to that of bridge or roof construction. That is, the load bearing deck can be defined by beams supported by trusses. The beams may extend longitudinally and transversely along the lower surface of the deck to provide base support for the deck. The trusses may extend diagonally through the deck from its upper surface to its lower surface, thereby providing supporting latticework to add rigidity to the beams and greatly increasing the ability to dissipate the compression and tension on the deck. If a load were applied to a beam in this example, the forces would dissipate through the truss, thereby increasing its load bearing capacity.

It will be appreciated by those skilled in the art, in view of these teachings, that alternative embodiments may be implemented without deviating from the spirit or scope of the invention. This invention is to be limited only by the following claims, which include all such embodiments and modifications when viewed in conjunction with the above specification and accompanying drawings.

What is claimed is:

1. A shipping pallet for supporting a load, comprising a load bearing deck that defines an upper surface for receiving said load and a lower surface opposite said upper surface, said load bearing deck comprising a plurality of domes, each dome defined by an apex located proximate to said upper surface and a plurality of legs extending from said apex and ending at said lower surface, said domes arranged in an array including a plurality of adjacent domes, said deck comprising structural fill extending between a plurality of legs of said adjacent domes, said structural fill connecting said adjacent domes to translate forces between said adjacent domes.

2. The shipping pallet of claim 1, wherein a plurality of said domes comprise a closed dome structure.

3. The shipping pallet of claim 1, wherein at least some of said domes comprise an open dome structure defined by a plurality of arches having apexes that define said dome apex and two legs extending from each of said arch apexes that define said dome legs, thereby forming open areas between said dome legs.

4. The shipping pallet of claim 3, wherein said arches comprise a partial dome configuration defined by said legs having a substantially non-vertical orientation at said lower surface.

5. The shipping pallet of claim 1, wherein said domes are shaped such that a load applied substantially to said dome apexes will be transmitted substantially laterally along said legs to produce intersecting compressive forces between adjacent domes.

6. The pallet of claim 1, wherein said upper surface of said load bearing deck defines an approximately flat plane, and wherein said dome apexes are configured to extend above said flat plane such that said upper surface of said deck is uneven.

7. The shipping pallet of claim 1, wherein said domes define a curvature, and wherein said curvature is substantially circular.

8. The shipping pallet of claim 7, wherein said curvature defines a radius of curvature, and wherein a distance between two adjacent dome apexes is approximately equal to two times said radius of curvature.

9. The shipping pallet of claim 1, wherein said domes comprise a non-circular shape.

10. The shipping pallet of claim 1, wherein said plurality of domes are situated in a plurality of dome rows that extend in at least two directions and intersect each other at a non-zero angle to form a pattern.

11. The shipping pallet of claim 10, wherein said pattern comprises a grid such that four adjacent dome apexes approximately define a square.

12. The shipping pallet of claim 10, wherein said pattern comprises a honeycomb such that any three adjacent dome apexes approximately define an equilateral triangle.

13. The shipping pallet of claim 1, wherein said lower surface of said deck comprises webbing that extends between said domes.

14. The shipping pallet of claim 13, wherein said lower surface of said deck comprises a plurality of ribs that extend downwardly from said webbing.

15. The shipping pallet of claim 14, wherein said plurality of ribs are situated between said domes.

16. The shipping pallet of claim 13, further comprising a plurality of beams that extend through a plurality of said domes and also extend from said upper surface of said deck to a point below said webbing.

17. The shipping pallet of claim 13, wherein:

said lower surface of said deck comprises a lower framework that has a plurality of ribs and beams;

said ribs are situated between said domes and extend downwardly from said webbing, and wherein said beams extend through a plurality of said domes and also extend from said upper surface of said deck to a point below said webbing.

18. The shipping pallet of claim 1, wherein each of said domes comprises a circular hoop at said lower surface of said load bearing deck.

19. The shipping pallet of claim 18, wherein said load bearing deck comprises webbing that extends between said circular hoops.

20. The shipping pallet of claim 1, further comprising a plurality of posts that extend from said lower surface of said deck.

21. The shipping pallet of claim 20, wherein said plurality of posts comprise stability ribs located therein.

22. The shipping pallet of claim 20, wherein said deck defines a center, and wherein said plurality of posts include a center post that extends from said center.

23. The shipping pallet of claim 22, wherein said center post comprises arched stability ribs within said center post.

24. The shipping pallet of claim 20, wherein said plurality of posts are situated to define spacing between said posts dimensioned to receive at least one of a forklift, palletjack and hand truck.

25. The shipping pallet of claim 20, wherein said plurality of posts comprise a bottom surface for resting on a surface, and wherein said pallet defines a height from said upper surface of said load bearing deck to said bottom surface of said posts which defines a low profile, such that said height is less than about 5.0 inches.

26. The shipping pallet of claim 1, wherein said deck is injection-molded in one unitary piece.

27. A shipping pallet for supporting a load, comprising:

a load bearing deck that defines an upper surface for receiving said load and a lower surface opposite said upper surface, said load bearing deck comprising a plurality of intersecting arch rows, each arch row comprising a plurality of adjacent arches, wherein each of said plurality of arches comprises an apex and two legs that extend from said apex to said lower surface of said deck, said arch rows being arranged such that said arches intersect approximately at their apexes thereby defining a plurality of domes that form an array of domes; and said deck further comprising structural fill that extends between legs of adjacent domes, said structural fill connecting said adjacent domes to translate forces between said adjacent domes, thereby strengthening said deck.

28. The shipping pallet of claim 27, wherein each of said plurality of arches comprise a partial arch configuration defined by said legs ending in a substantially non-vertical orientation.

29. The shipping pallet of claim 27, wherein each of said plurality of arches defines a curvature, and wherein said curvature is substantially circular.

30. The shipping pallet of claim 29, wherein said curvature defines a radius of curvature, and wherein a distance between two adjacent arch apexes is approximately equal to two times said radius of curvature.

31. The shipping pallet of claim 27, wherein each of said plurality of arches comprises a non-circular shape.

32. The shipping pallet of claim 27, wherein said plurality of intersecting arch rows comprises a first set of parallel arch rows that extend in a first direction and a second set of parallel arch rows that extend in a second direction, and wherein said second direction intersects said first direction at an angle of about 90°.

33. The shipping pallet of claim 27, wherein said plurality of intersecting arch rows comprise a first set of parallel arch rows that extend in a first direction, a second set of parallel arch rows that extend in a second direction, and a third set of parallel arch rows that extend in a third direction, and wherein said second direction intersects said first direction at an angle of about 60° and said third direction intersects said first direction at an angle of about 120°.

34. The shipping pallet of claim 27, wherein said plurality of intersecting arch rows comprise a first set of parallel arch rows that extend in a first direction, a second sot of parallel arch rows that extend in a second direction, a third set of parallel arch rows that extend in a third direction, and a fourth set of a parallel arch rows that extend in a fourth direction, and wherein said second direction intersects said first direction at an angle of about 60°, said third direction intersects said first direction at an angle of about 90°, and said fourth direction intersects said first direction a an angle of about 120°.

35. The shipping pallet of claim 27, wherein said domes are situated and shaped such that a load applied to said arch apexes will be transmitted substantially laterally to produce intersecting compressive forces between adjacent domes.

36. The pallet of claim 27, wherein said upper surface of said load bearing deck defines an approximately flat plane, and wherein said arch apexes are configured to extend above said flat plane such that said upper surface of said deck is uneven.

37. The shipping pallet of claim 27, wherein said lower surface of said deck comprises webbing that extends between said plurality of domes.

38. The shipping pallet of claim 37, wherein said lower surface of said deck comprises a plurality of ribs that extend downwardly from said webbing.

39. The shipping pallet of claim 38, wherein said plurality of ribs are situated between said domes.

40. The shipping pallet of claim 37, further comprising a plurality of beams that extend through at least one row of said plurality of domes and also extend from said upper surface of said deck to a point below said webbing.

41. The shipping pallet of claim 37, wherein said lower surface of said deck comprises a lower framework that has a plurality of ribs and beams, wherein:

said ribs are situated between said domes and extend downwardly from said webbing; and said beams extend through at least one row of said plurality of domes and also extend from said upper surface of said deck to a point below said webbing.

42. The shipping pallet of claim 27, further comprising a plurality of posts that extend from said lower surface of said deck.

43. The shipping pallet of claim 42, wherein said plurality of posts comprise stability ribs located therein.

44. The shipping pallet of claim 42, wherein said deck defines a center, and wherein said plurality of posts include a center post that extends approximately from said center.

45. The shipping pallet of claim 44, wherein said center post comprises arched stability ribs within said post.

46. The shipping pallet of claim 42, wherein said plurality of posts are situated to define spacing between said posts dimensioned to receive at least one of a forklift, palletjack and hand truck.

47. The shipping pallet of claim 42, wherein said plurality of posts comprise a bottom surface, and wherein said pallet defines a height from said upper surface of said load bearing deck to said bottom surface of said posts which defines a low profile, such that said height is less than about 5.0 inches.

48. The shipping pallet of claim 27, wherein said deck is injection-mold in one unitary piece.

49. A shipping pallet for supporting a load, comprising:

a load bearing deck that defines an upper surface for receiving the load and a lower surface opposite said upper surface, said load bearing deck comprising a plurality of domes, each dome defined by an apex located proximate to said upper surface and a plurality of legs extending from said apex and ending at said lower surface, said domes arranged in an array including a plurality of adjacent domes;

structural fill extending between a plurality of legs of said adjacent domes, said structural fill connecting said adjacent domes to translate forces between said adjacent domes, thereby strengthening said deck; and a plurality of posts that extend from said lower surface of said deck, wherein at least some of said domes comprise an open dome structure defined by a plurality of arches having apexes that define said dome apex and two legs extending from each of said arch apexes that define said dome legs, thereby forming said open dome structure that has open areas between said dome legs, wherein said arches comprise a partial dome configuration defined by said legs having a substantially non-vertical orientation at said lower surface, and wherein said plurality of domes are situated in a plurality of dome rows that extend in a least two directions and intersect each other at a non-zero angle to form a pattern.

50. The shipping pallet of claim 49, wherein said domes define a curvature, and wherein said curvature is substantially circular.

51. The shipping pallet of claim 50, wherein said curvature defines a radius of curvature, and wherein a distance between two adjacent dome apexes is approximately equal to two times said radius of curvature.

52. The shipping pallet of claim 49, wherein said domes comprise a non-circular shape.

53. The shipping pallet of claim 49, wherein said pattern comprises a grid such that four adjacent dome apexes approximately define a square.

54. The shipping pallet of claim 49, wherein said pattern comprises a honeycomb such that any three adjacent dome apexes approximately define an equilateral triangle.

55. The shipping pallet of claim 49, wherein said lower surface of said deck comprises webbing that extends between said domes.

56. The shipping pallet of claim 55, wherein said lower surface of said deck further comprises a lower framework that has a plurality of ribs and beams, wherein:

said ribs are situated between said domes and extend downwardly from said webbing; and said beams extend through a plurality of said domes and also extend from said upper surface of said deck to a point below said webbing.

57. The shipping pallet of claim 49, wherein said deck is injection-molded in one unitary piece.

* * * * *